US010513964B2

(12) United States Patent
Lee et al.

(10) Patent No.: US 10,513,964 B2
(45) Date of Patent: Dec. 24, 2019

(54) ENGINE COOLING SYSTEM

(71) Applicants: Hyundai Motor Company, Seoul (KR); Kia Motors Corporation, Seoul (KR)

(72) Inventors: Hyo Jo Lee, Gyeonggi-do (KR); Yonggyu Lee, Gyeonggi-do (KR); Woo Yeol Jung, Gyeonggi-do (KR); Tae Man Chung, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 90 days.

(21) Appl. No.: 15/834,666

(22) Filed: Dec. 7, 2017

(65) Prior Publication Data

US 2019/0085750 A1 Mar. 21, 2019

(30) Foreign Application Priority Data

Sep. 21, 2017 (KR) ..... 10-2017-0121898

(51) Int. Cl.

| | |
|---|---|
| ***F01P 3/02*** | (2006.01) |
| ***F02F 1/14*** | (2006.01) |
| ***F01P 3/22*** | (2006.01) |
| *F01P 7/14* | (2006.01) |

(52) U.S. Cl.

CPC ..... *F01P 3/02* (2013.01); *F01P 3/22* (2013.01); *F02F 1/14* (2013.01); *F01P 2003/027* (2013.01); *F01P 2007/146* (2013.01); *F01P 2025/31* (2013.01); *F01P 2025/33* (2013.01)

(58) Field of Classification Search

CPC ..... F01P 3/02; F01P 3/22; F01P 2003/027; F01P 2007/146

USPC ..... 123/41.01–41.85

See application file for complete search history.

(56) References Cited

U.S. PATENT DOCUMENTS

| | | | | |
|---|---|---|---|---|
| 5,385,123 | A * | 1/1995 | Evans | F01P 3/02 123/41.21 |
| 6,880,496 | B2 * | 4/2005 | Batzill | F01P 7/16 123/41.1 |
| 9,518,503 | B2 | 12/2016 | Tsuchiya et al. | |
| 2009/0301414 | A1 * | 12/2009 | Netsu | F01M 5/00 123/41.72 |
| 2011/0232590 | A1 * | 9/2011 | Benet | F01P 3/02 123/41.09 |
| 2014/0290600 | A1 * | 10/2014 | Lee | F01P 3/02 123/41.29 |

(Continued)

FOREIGN PATENT DOCUMENTS

| | | |
|---|---|---|
| JP | 2015-059615 A | 3/2015 |
| KR | 10-1558377 | 10/2015 |
| KR | 10-1713742 | 3/2017 |

*Primary Examiner* — John Kwon
*Assistant Examiner* — Johnny H Hoang
(74) *Attorney, Agent, or Firm* — Mintz, Levin Cohn Ferris Glovsky and Popeo, P.C.; Peter F. Corless

(57) ABSTRACT

An engine cooling system is provided. The system includes a cylinder block formed that has a block coolant chamber formed therein and a front insert that is inserted downward of an upper portion of a front side and receives coolant in the block coolant chamber to adjust a flow of the coolant. Additionally, a rear insert is inserted downward of an upper portion of a rear side and exhausts the coolant in the block coolant chamber to adjust the flow of the coolant.

16 Claims, 8 Drawing Sheets

(56) References Cited

U.S. PATENT DOCUMENTS

| | | | | |
|---|---|---|---|---|
| 2016/0258341 | A1* | 9/2016 | Yoon | F01P 7/16 |
| 2017/0067389 | A1* | 3/2017 | Cha | F01P 3/20 |

* cited by examiner

ENGINE COOLING SYSTEM

CROSS-REFERENCE TO RELATED APPLICATION

This application claims priority to and the benefit of Korean Patent Application No. 10-2017-0121898 filed on Sep. 21, 2017, the entire contents of which are incorporated herein by reference.

BACKGROUND

(a) Field of the Invention

The present invention relates to an engine cooling system, and more particularly, to an engine cooling system capable of reducing a warm-up time of an engine and improving an overall cooling efficiency by adjusting coolant flowing through a cylinder block based on a driving condition.

(b) Description of the Related Art

An engine exhausts heat energy while generating torque according to combustion of a fuel, and coolant circulates an engine, a heater and a radiator to absorb the heat energy so that the engine exhausts the absorbed coolant to the outside. When a temperature of the coolant in the engine is low, a viscosity of oil is increased to increase a frictional force, fuel consumption is increased, a temperature of exhaust gas is slowly increased and thus, an activation time of a catalyst may be increased and the quality of exhaust gas may be deteriorated. Further, a normalized time of a function in a heater may be increased thus causing the user discomfort.

Further, when a temperature of coolant in an engine is overheated, knocking occurs. To suppress the knocking, ignition timing is adjusted which causes the performance of the engine to deteriorate. When a temperature of a lubricant is excessive, the viscosity is reduced thus deteriorating a function of lubrication. Accordingly, a technology of increasing a temperature of the coolant in a specific region of the engine, and reducing temperature of the coolant in remaining regions of the engine has been developed. Particularly, a technology of controlling a flow of the coolant through one coolant control valve unit has been applied. Meanwhile, researches and studies have been performed regarding a technology where one coolant control valve unit controls coolant passing through a radiator, a heater core, an exhaust gas recirculation (EGR) cooler, an oil cooler, or a cylinder block.

The above information disclosed in this section is merely for enhancement of understanding of the background of the invention and therefore it may contain information that does not form the prior art that is already known in this country to a person of ordinary skill in the art.

SUMMARY

The present invention provides an engine cooling system having advantages of reducing a warm-up time in a low temperature condition by adjusting coolant flowing through a cylinder block using a coolant control valve unit installed at a rear side of a cylinder head, and a block coolant chamber moves the coolant to a head coolant chamber. An exemplary embodiment of the present invention provides an engine cooling system that may include: a cylinder block formed therein with a block coolant chamber; a front insert inserted downward of an upper portion of a front side receiving coolant in the block coolant chamber to adjust a flow of the coolant; and a rear insert inserted downward of an upper portion of a rear side exhausting the coolant in the block coolant chamber to adjust a flow of the coolant.

The front insert may include: a first body having a bottom surface supported by a bottom surface of the block coolant chamber; and a first handle that extends a top surface of the cylinder block formed therein with the block coolant chamber from a top surface of the first body by a first preset distance. The first body may include a bar type body formed according to a shape of the block coolant chamber. An exterior diameter of the first handle may be less than an exterior diameter of the first body.

The rear insert may include: a second body having a bottom surface supported by a projection formed to have a preset height from the block coolant chamber; and a second handle that extends to a top surface of the cylinder block formed therein with the block coolant chamber from a top surface of the second body by a second preset distance. The second body may include a bar type body formed according to a shape of the block coolant chamber. An exterior diameter of the second handle may be less than an exterior diameter of the second body.

The block coolant chamber may be formed therein with a lower chamber at a lower portion of the projection, and may be formed therein with an upper chamber at an upper portion of the projection. The front insert may be disposed at an intake side of the cylinder block in the block coolant chamber. The rear insert may be disposed at an exhaust side of the cylinder block in the block coolant chamber. The engine cooling system may further include an intake side insert and an exhaust side insert disposed at an intake side and an exhaust side between the front insert and the rear insert in the block coolant chamber to adjust a flow of the coolant.

The intake side insert and the exhaust side insert may be formed therein with a rising part having an increased height and a descending part having a reduced height, respectively, and a handle is formed between the rising part and the descending part. The engine cooling system may further include a cylinder head disposed above the cylinder block; and a head gasket interposed between the cylinder head and the cylinder block. The head gasket may be formed therein with first and second main passages through which the coolant may pass from a front side of the block coolant chamber to a front side of the head coolant chamber. Further, the head gasket may be formed therein with an auxiliary passage through which the coolant may pass to the head coolant chamber in the block coolant chamber, and the auxiliary passage may include first and second auxiliary passages formed at a front side and a rear side of the front insert, respectively.

The engine cooling system may further include a coolant control valve unit mounted at a rear side of the cylinder head configured to receive the coolant from the head coolant chamber and to adjust the coolant exhausted from the block coolant chamber. In addition, the engine cooling system may further include: a block coolant temperature sensor configured to detect coolant flowing through the block coolant chamber; and a valve coolant temperature sensor configured to detect coolant flowing through the coolant control valve unit. The block coolant chamber may be formed therein with a bridge passage to connect an exhaust side with an intake side between cylinders. The coolant control valve unit may be configured to adjust coolant exhausted from an outlet located at an intake side rather than the rear insert in a rear side of the block coolant chamber.

The engine cooling system may further include a coolant pump configured to pump the coolant to an inlet disposed at an exhaust side rather than the front insert at a front side of the block coolant chamber. According to an exemplary embodiment of the present invention, a front insert inserted into a front side of a block coolant chamber and a rear insert inserted into a rear side may efficiently adjust a flow of coolant of the block coolant chamber. In other words, a flow of the coolant in the block coolant chamber may be stopped or blocked more efficiently.

Further, the coolant pumped from a coolant pump through first and second main passages formed at a front side of a head gasket may be moved more efficiently to a block coolant chamber from a head coolant chamber. In addition, in a coolant flow state or a coolant flow stop state of the block coolant chamber, the flow of the coolant may be improved in a coolant flow stop state or a coolant flow state of the block coolant chamber by flowing the coolant from a block coolant chamber to a head coolant chamber through first and second auxiliary passages formed at an intake side of a front side of the head gasket.

BRIEF DESCRIPTION OF THE DRAWINGS

The above and other aspects, features and advantages of the present invention will be more apparent from the following detailed description taken in conjunction with the accompanying drawings, in which.

DESCRIPTION OF SYMBOLS

Figure 1:
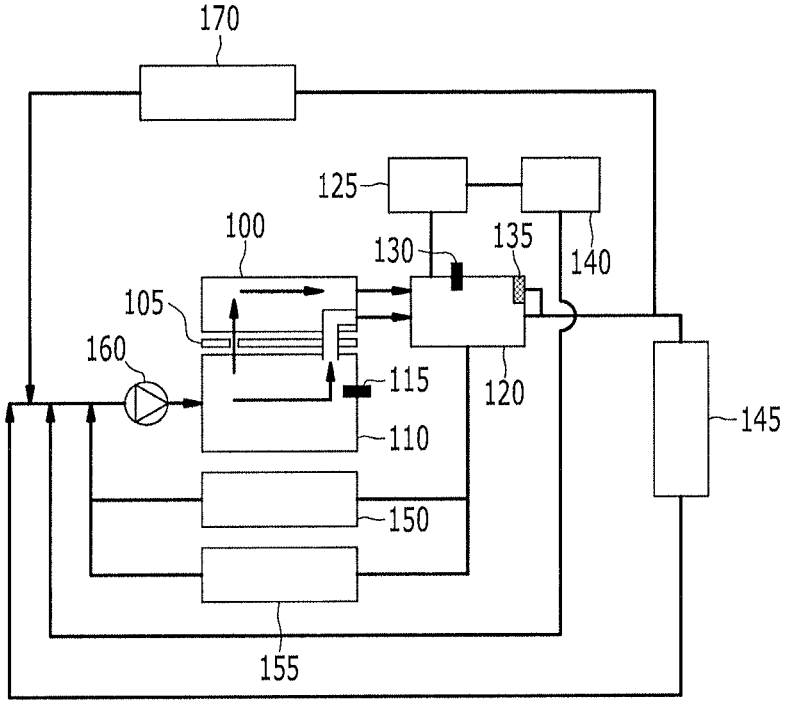
FIG. 1 is a schematic diagram illustrating a configuration of an engine cooling system according to an exemplary embodiment of the present invention.

100: cylinder head
105: head gasket
110: cylinder block
115: block coolant temperature sensor
120: coolant control valve unit
125: low pressure EGR cooler
130: valve coolant temperature sensor
135: safety valve
140: heater core
145: radiator
150: EGR valve
155: oil cooler
160: coolant pump
170: reservoir tank
200: head coolant chamber
210: block coolant chamber
210*a*: upper chamber
210*b*: lower chamber
215: front insert
220: rear insert
404: first body
402: first handle
414: second body
412: second handle
300: exhaust side insert
310: intake side insert
350: rising par
352: descending part
354: handle
360: bridge passage
400: projection
408: top surface
406: bottom surface
222: transmission oil warmer
L1: first length
L2: second length
501: first main passage
502: second main passage
503: first auxiliary passage
504: second auxiliary passage

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Hereinafter, an exemplary embodiment of the present invention will be described in detail with reference to the accompanying drawings. However, the size and thickness of each configuration shown in the drawings are optionally illustrated for better understanding and ease of description, the present invention is not limited to shown drawings. In the drawings, the thickness of layers, films, panels, regions, etc., are exaggerated for clarity. Accordingly, the drawings and description are to be regarded as illustrative in nature and not restrictive. Like reference numerals designate like elements throughout the specification. It will be understood that, although the terms first and second etc. may be used herein to describe various elements, these elements should not be limited by these terms. These terms are used to distinguish one element from another.

FIG. 1 is a schematic diagram illustrating a configuration of an engine cooling system according to an exemplary embodiment of the present invention. Referring to FIG. 1, the engine cooling system may include a cylinder head 100, a head gasket 105, cylinder block 110, a block coolant temperature sensor 115, coolant control valve unit 120, a valve coolant temperature sensor 130, a safety valve 135, a reservoir tank 170, a low pressure EGR cooler 125, a heater core 140, a radiator 145, an EGR valve 150, an oil cooler 155, and a coolant pump 160.

The cylinder head 100 may be disposed above the cylinder block 110 and the head gasket 105 may be interposed between the cylinder block 110 and the cylinder head 100. The coolant pump 160 may be mounted at a front side of the cylinder block 110 and the coolant control valve unit 120 may be mounted at a rear side of the cylinder head 100. Additionally, coolant pumped from the coolant pump 160 may be supplied to the front side of the cylinder block 110, a portion (e.g., a first portion) of the coolant pumped to the front side of the cylinder block 110 may be supplied to a front side of the cylinder head 100 through the head gasket 105, and remaining coolant (e.g., a second portion) may flow to a rear side of the cylinder block 110.

Here, the front side of the cylinder block 110 represents a portion of the cylinder block 110 at which the coolant pump 160 is mounted, and the rear side of the cylinder block 110 represents the opposite portion of the front side of the cylinder block. In addition, the rear side of the cylinder head 100 represents a portion of the cylinder head 100 at which the coolant control valve unit 120 is mounted, and the front side of the cylinder head 100 represents the opposite portion of the rear side of the cylinder head 100. In addition, each of the cylinder block 110 and the cylinder head 100 includes two sides (an intake side and an exhaust side) connecting the front side and the rear side. The intake side represents one side (or side portion) of the two sides close to intake valves and the exhaust side represents another side (or side portion) opposite to the one side, which is close to exhaust valves.

The coolant flowing to the rear side inside the cylinder block 110 may rise, and pass through the head gasket 105, and may be supplied to the coolant control valve unit 120 engaged with the rear side of the cylinder head 100. The coolant supplied to the front side of the cylinder head 100 may flow to the rear side of the cylinder head 100 and may be supplied to the coolant control valve unit 120 mounted at the rear side of the cylinder head 100. The coolant control valve unit 120 may be configured to control the coolant exhausted from the cylinder block 110 and the coolant exhausted from the cylinder head 100 may circulate to the coolant control valve unit 120.

A block coolant temperature sensor 115 configured to detect a temperature of coolant may be disposed in the cylinder block 110 and a valve coolant temperature sensor 130 configured to detect a temperature of the coolant in the coolant control valve unit 120 may be disposed at the coolant control valve unit 120. The coolant control valve unit 120 may be configured to adjust coolant distributed to the low pressure EGR cooler 125 and the heater core 140, and adjust coolant distributed to the radiator 145, and supply the coolant to the low pressure EGR cooler 125 and the oil cooler 155. In other words, the coolant control valve unit 120 may be configured to adjust the amount of coolant flowing to the other components based on an opening degree thereof. Further, an EGR line (not shown) is branched from a downstream side of a turbocharger (not shown) in an exhaust line and is joined to an intake line, and the low pressure EGR cooler 125 may be disposed on the EGR line, and may be configured to cool a recirculating exhaust gas (EGR gas), and the heater core 140 may be configured to heat indoor air of the vehicle.

The radiator 145 may be disposed to emit heat of the coolant to the outside, the EGR valve 150 may be configured to adjust a flow rate of the EGR gas in the EGR line, and the oil cooler 155 may be disposed to cool oil circulating the engine. The reservoir tank 170 may be disposed on a separate line branched from a coolant line from the coolant control valve unit 120 to the radiator 145, and the reservoir tank 170 may be configured to collect bubbles in the coolant or may supplement the coolant to a cooling system. The safety valve 135 may be mechanically operated based on a coolant temperature. When the coolant temperature is overheated due to failure of the coolant control valve unit 120, the safety valve 135 may be configured to open a bypass passage connected with the radiator 145. Accordingly, the safety valve 135 may prevent overheating of the coolant. The various valves discussed herein may be operated by an overall controller of the system.

Figure 2:
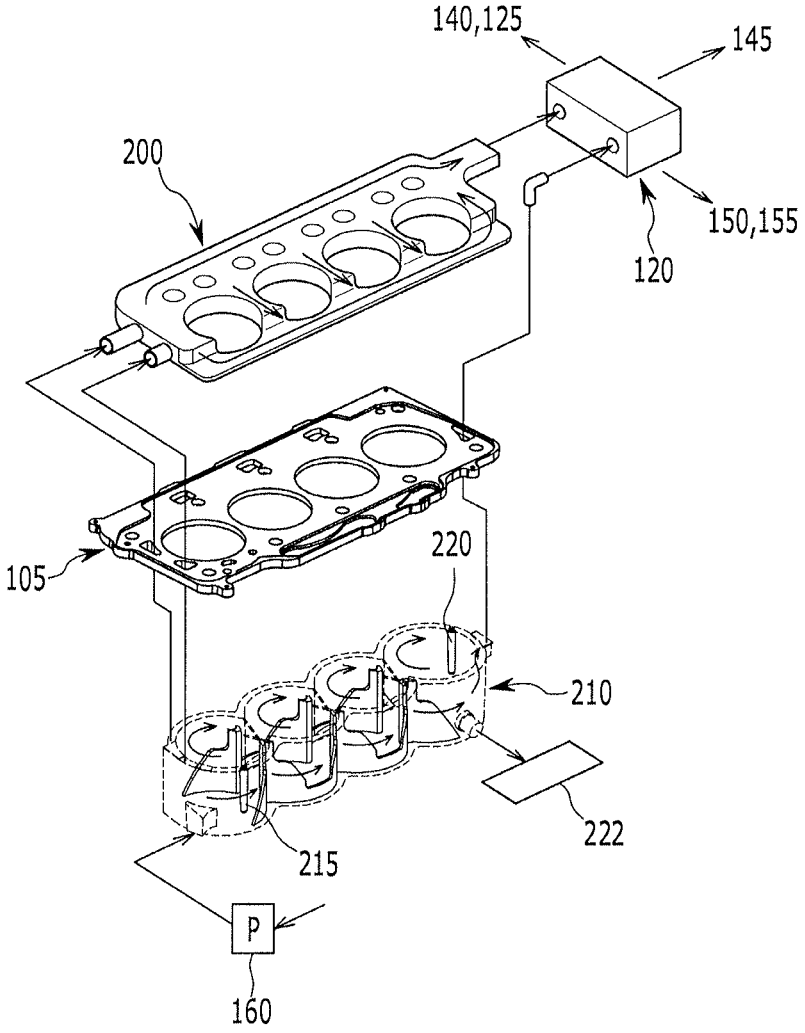
FIG. 2 is a partial perspective view illustrating a coolant chamber in an engine cooling system according to an exemplary embodiment of the present invention.

In an exemplary embodiment of the present invention, cooling components may include the cylinder head, the cylinder block, the oil cooler, the EGR cooler, the heater core, the radiator, the transmission oil warmer and the EGR valve described as above as constituent elements using substantially coolant. FIG. 2 is a partial perspective view illustrating a coolant chamber in an engine cooling system according to an exemplary embodiment of the present invention.

Referring to FIG. 2, the cooling system may include a coolant pump 160, a block coolant chamber 210, a front insert 215, a rear insert 220, a transmission oil warmer 222, a head gasket 105, and a head coolant chamber 200.

Each of the block coolant chamber 210 and the head coolant chamber includes a front side, a rear side, an intake side and an exhaust side. The front side is a side (or portion) close to the coolant pump 160, and the rear side is a side (or portion) opposite to the front side. The intake side and the exhaust side connect the front side and the rear side, respectively. The intake side is a side (or a side portion) close to the intake valves, and the exhaust side is a side (or a side portion) close to the exhaust valves and opposite to the intake side.

The coolant pumped from the coolant pump 160 may be supplied to the front side of the block coolant chamber 210, and a part of the supplied coolant may be supplied to the front side of the head coolant chamber 200 through the head gasket 105. The remaining supplied coolant may flow through the block coolant chamber 210.

The front insert 215 and the rear insert 220 may be inserted into the block coolant chamber 210 downwardly, and may at least partially hinder a flow of the coolant through the block coolant chamber 210. Particularly, a coolant flow stop state of the block coolant chamber 210 may be implemented. The coolant flowing to the rear side of the head coolant chamber 200 may circulate to the coolant control valve unit 120, and the coolant flowing to the rear side of the block coolant chamber 210 may rise through the head gasket 105, and circulate to the coolant control valve unit 120. The coolant control valve unit 120 may be configured to receive the coolant from the head coolant chamber 200. Further, the transmission oil warmer 222 may be configured to heat transmission oil by the coolant, and a detailed structure and function thereof refer to a technology known in the art.

Figure 3:
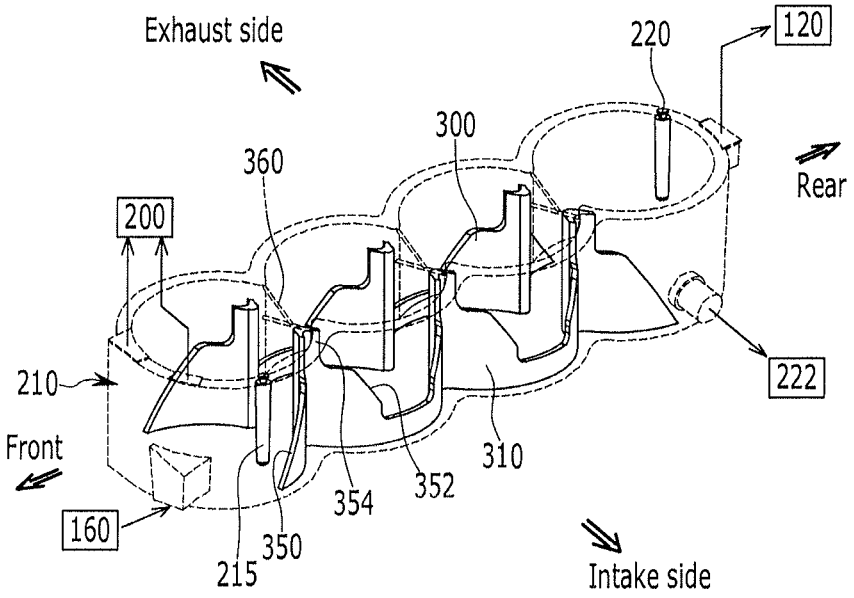
FIG. 3 is a partial perspective view illustrating a block coolant chamber in an engine cooling system according to an exemplary embodiment of the present invention.

FIG. 3 is a partial perspective view illustrating a block coolant chamber in an engine cooling system according to an exemplary embodiment of the present invention. Referring to FIG. 3, a front insert 215, a rear insert 220, an intake side insert 310, and an exhaust side insert 300 may be inserted downwardly into the block coolant chamber 210, respectively.

In particular, the front insert 215 may be disposed at a front portion of the intake side of the block coolant chamber 210, and the rear insert 220 may be disposed at a rear portion of the exhaust side of the block coolant chamber 210. In other words, the front insert 215 may be disposed close to the front side of the block coolant chamber 210 that receives the coolant, and the rear insert 220 may be disposed close to the rear side of the block coolant chamber 210 that exhausts or discharges the coolant. The intake side insert 310 and the exhaust side insert 300 may be disposed in the intake side and the exhaust side of the block coolant chamber 210, respectively, between the front insert 215 and the rear insert 220 and may be configured to control a flow of the coolant. Further, the intake side insert 310 and the exhaust side insert 300 may be formed therein with a rising part 350 having a height gradually increased from the front side to the rear side and a descending part 352 having a height gradually reduced from the front side to the rear side, respectively. A handle 354 may be formed between the rising part 350 and the descending part 352.

In an exemplary embodiment of the present invention, the block coolant chamber 210 may be formed at the cylinder block and may be formed around a cylinder in which a piston (not shown) is disposed. The block coolant chamber 210 may be formed therein with a bridge passage 360 to connect the exhaust side with the intake side between cylinders. When the coolant control valve unit 120 opens an outlet of the block coolant chamber 210, the coolant flowing to the exhaust side of the block coolant chamber 210 may flow to the intake side of the block coolant chamber 210 through the bridge passage 360.

In an exemplary embodiment of the present invention, referring to FIG. 2 and FIG. 3, the coolant control valve unit 120 may be configured to adjust the coolant exhausted from the outlet of the block coolant chamber 210 disposed at the rear side of the block coolant chamber 210. Furthermore, the coolant pump 160 may be configured to pump the coolant to an inlet disposed at the front side of the block coolant chamber 210.

Figure 4A:
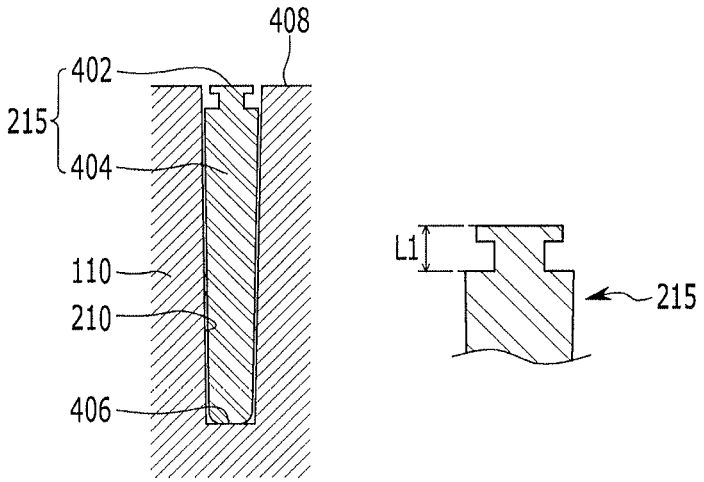
FIG. 4A is a partial cross-sectional view illustrating an engagement state of a front insert in an engine cooling system according to an exemplary embodiment of the present invention.

FIG. 4A is a partial cross-sectional view illustrating an engagement state of a front insert in an engine cooling system according to an exemplary embodiment of the present invention. Referring to FIG. 4A, the cylinder block 110 may be formed therein with the block coolant chamber 210 having a preset depth from a top to a bottom thereof. A bottom surface 406 may be formed at the bottom of the block coolant chamber 210. A top surface 408 on which the head gasket 105 is disposed may be formed at an upper portion of the cylinder block 110.

The front insert 215 may include a first body 404 inserted to the bottom surface 406 of the block coolant chamber 210, and the first body 404 may have a bar shape. A first handle 402 may extend upwardly from a center of a top surface of the first body 404. A bottom surface of the front insert 215 may be supported by the bottom surface 406. The first handle 402 may extend from the top surface of the first body 404 by a first preset distance L1 to extend to the top surface 408 of the cylinder block 110. Further, an exterior diameter of the first handle 402 may be less than an exterior diameter of the first body 404. The exterior diameter of the first handle 402 may be less than a width of the block coolant chamber 210.

Figure 4B:
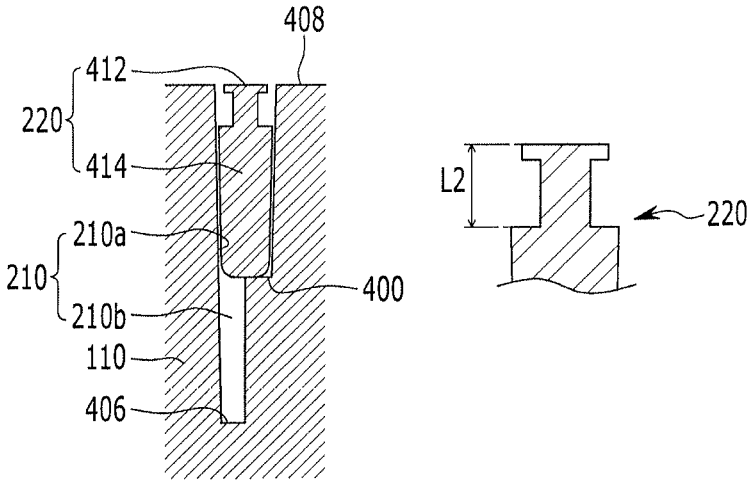
FIG. 4B is a partial cross-sectional view illustrating an engagement state of a rear insert in an engine cooling system according to an exemplary embodiment of the present invention.

FIG. 4B is a partial cross-sectional view illustrating an engagement state of a rear insert in an engine cooling system according to an exemplary embodiment of the present invention. Referring to FIG. 4B, the cylinder block 110 may be formed therein with the block coolant chamber 210 having a preset depth from the top to the bottom thereof. The bottom surface 406 may be formed at the bottom of the block coolant chamber 210. The top surface 408 on which the head gasket 105 is disposed may be formed at the upper portion of the cylinder block 110.

Further, a projection 400 may be formed at a position having a preset height from the bottom surface 406 of the block coolant chamber 210. The block coolant chamber 210 may be divided into a lower chamber 210*b* and an upper chamber 210*a* by the projection 400. In particular, due to the projection 400, a width of the lower chamber 210*b* may be narrower than a width of the upper chamber 210*a*. The rear insert 220 may include a second body 414 inserted to the projection 400 of the block coolant chamber 210. The second body 414 may have a bar shape.

Additionally, the second handle 412 may be formed at a center of a top surface of the second body 414. A bottom surface of the rear insert 220 may be supported by the projection 400. The second handle 412 may extend from the top surface of the second body 414 by a second preset distance L2 to extend to the top surface 408 of the cylinder block 110. Further, an exterior diameter of the second handle 412 may be less than an exterior diameter of the second body 414. The exterior diameter of the second handle 412 may be less than the width of the block coolant chamber 210. In an exemplary embodiment of the present invention, the second preset distance L2 may be greater than the first preset distance L1. The second preset distance L2 may be about 10 mm, and the first preset distance L1 may be about 5 mm.

Figure 5:
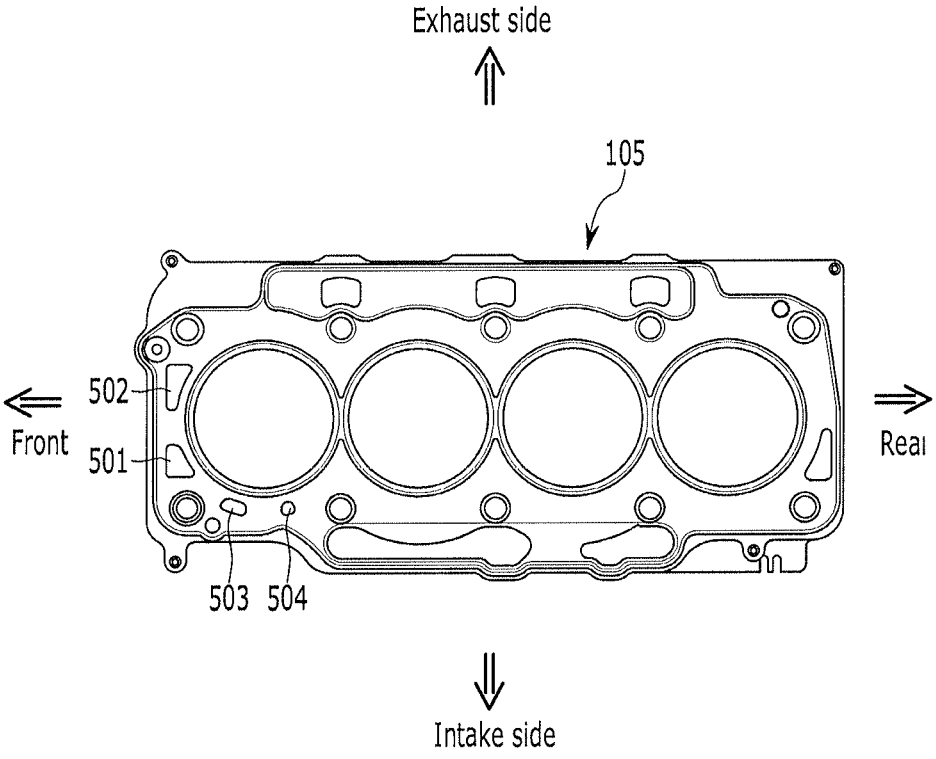
FIG. 5 is a plan view illustrating a head gasket according to an exemplary embodiment of the present invention.

FIG. 5 is a plan view illustrating a head gasket according to an exemplary embodiment of the present invention. Referring to FIG. 5, first and second main passages 501 and 502 may be formed at a front side of the head gasket 105. First and second auxiliary passages 503 and 504 may be formed at a front portion of an intake side of the head gasket 105.

Here, the front side of the head gasket 105 represents a portion of the head gasket 105 corresponding to the front sides of the cylinder block 110 and the cylinder head 100, and the rear side of the head gasket 105 represents the opposite portion of the front side of the head gasket 105. In addition, the head gasket 105 includes two sides (the intake side and an exhaust side) connecting the front side and the rear side. The intake side represents one side (or side portion) of the two sides close to the intake valves and the exhaust side represents another side (or side portion) opposite to the one side, which is close to the exhaust valves.

When the coolant pump 160 pumps the coolant to the front side of the block coolant chamber 210, a portion (e.g., a first portion or a first amount) of the coolant rises and passes through the first and second main passages 501 and 502 of the head gasket 105 and may be supplied to the front side of the head coolant chamber 200. In addition, another portion of the pumped coolant may be moved toward the rear side of the block coolant chamber 210, rises through the first and second auxiliary passages 503 and 504 to be supplied to the head coolant chamber 200. In an exemplary embodiment of the present invention, the front insert 215 may be disposed between the first and second auxiliary passages 503 and 504 in the block coolant chamber 210. In other words, the first and second auxiliary passages 503 and 504 may be formed in front and at the rear of the front insert 215, respectively.

Figure 6:
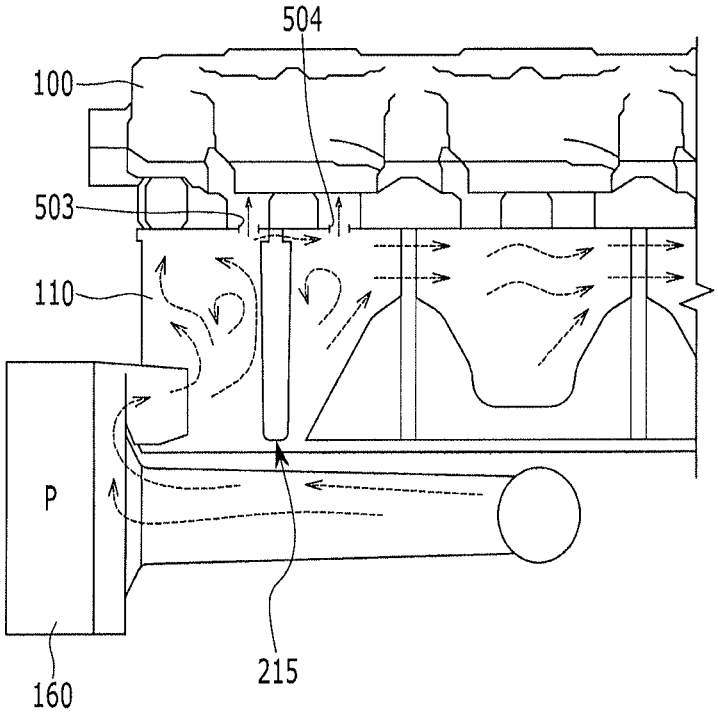
FIG. 6 is a partial side view illustrating a flow of coolant in an engine cooling system according to an exemplary embodiment of the present invention.

FIG. 6 is a partial side view illustrating a flow of coolant in an engine cooling system according to an exemplary embodiment of the present invention. Referring to FIG. 6, when the coolant control valve unit 120 opens the outlet of the block coolant chamber 210, a portion of the coolant pumped to the front side of the block coolant chamber 210 may be supplied into the head coolant chamber 200 through the first and second main passages 501 and 502. Another portion of the coolant may flow toward the rear side of the block coolant chamber 210 through the intake side and the exhaust side of the block coolant chamber 210. The coolant flowing through the exhaust side of the block coolant chamber 210 may flow to the rear side of the block coolant chamber 210 through an upper portion (the second handle 412) of the rear insert 220 and the lower chamber 210*b*. Furthermore, the coolant flowing through the intake side of the block coolant chamber 210 may flow toward the rear side of the block coolant chamber 210 through an upper portion (the first handle 402) of the front insert 215. Moreover, a portion of the coolant flowing through the intake side of the block coolant chamber 210 may be supplied to the head coolant chamber 200 through the first and second auxiliary passages 503 and 504. The coolant flowing to the rear side of the block coolant chamber 210 flows to the head coolant chamber 200 through the outlet of the block coolant chamber 210. In addition, the coolant supplied to the head coolant chamber 200 flows to the rear side of the head coolant chamber 200 and is discharged to the coolant control valve unit 120.

Figure 7:
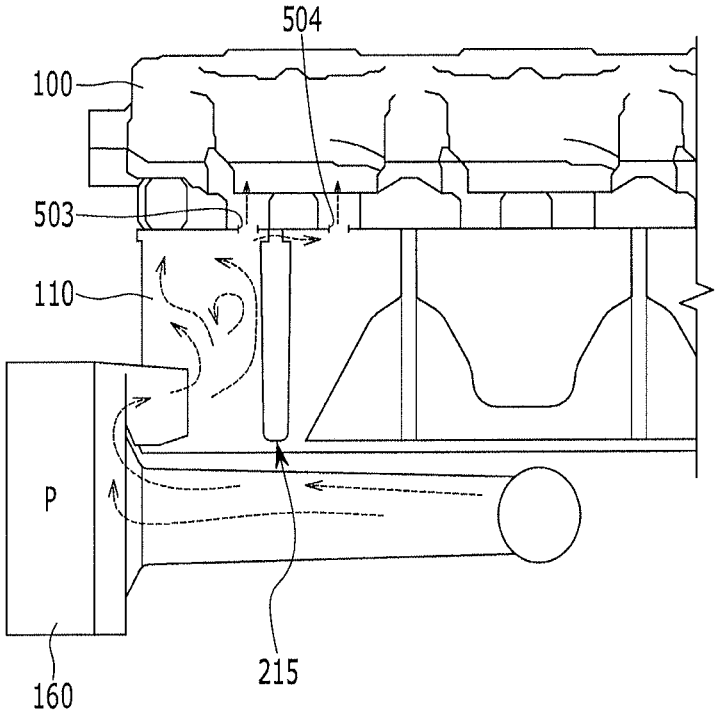
FIG. 7 is a partial side view illustrating a flow of coolant in an engine cooling system according to an exemplary embodiment of the present invention.

FIG. 7 is a partial side view illustrating a flow of coolant in an engine cooling system according to an exemplary embodiment of the present invention. Referring to FIG. 7, when the coolant control valve unit 120 closes the outlet of the block coolant chamber 210, the coolant pumped to the front side of the block coolant chamber 210 may be supplied into the head coolant chamber 200 through the first and second main passages 501 and 502. In addition, a portion of the coolant may be supplied to the head coolant chamber 200 through the first auxiliary passage. Another portion of the coolant moved toward the rear side of the block coolant chamber 210 through the upper portion of the front insert 215 may be supplied to the head coolant chamber 200 through the second auxiliary passage 504. Therefore, most of the coolant flows to the coolant control valve unit 120 not through the block coolant chamber 210 but through the head coolant chamber 200.

While this invention has been described in connection with what is presently considered to be exemplary embodiments, it is to be understood that the invention is not limited to the disclosed exemplary embodiments. On the contrary, it is intended to cover various modifications and equivalent arrangements included within the spirit and scope of the appended claims.

What is claimed is:

1. An engine cooling system, comprising:

a cylinder block having a block coolant chamber formed therein, the block coolant chamber including a front side to which coolant is supplied, a rear side opposite to the front side, and an intake side and an exhaust side disposed between the front side and the rear side and opposite to each other;

a front insert inserted into a front portion of the intake side of the block coolant chamber and at least partially hindering a flow of the coolant to the rear side of the block coolant chamber through the intake side; and a rear insert inserted into a rear portion of the exhaust side of the block coolant chamber and at least partially hindering a flow of the coolant to the rear side of the block coolant chamber through the exhaust side, wherein the coolant supplied to the cylinder block at the front side is capable of flowing to the rear side through the intake side and the exhaust side and of being exhausted out of the block coolant chamber from the rear side.

2. The engine cooling system of claim 1, wherein the front insert includes:

a first body having a bar type body formed according to a shape of the block coolant chamber, a bottom surface of the first body being supported by a bottom surface of the block coolant chamber; and a first handle that extends from a top surface of the first body to a top surface of the cylinder block, an exterior diameter of the first handle being less than an exterior diameter of the first body.

3. The engine cooling system of claim 2, wherein the coolant flowing to the rear side of the block coolant chamber through the intake side is capable of passing the front insert through the first handle.

4. The engine cooling system of claim 1, wherein the rear insert includes:

a second body having a bar type body formed according to a shape of the block coolant chamber, a bottom surface of the second body being supported by a projection formed apart from a bottom surface of the block coolant chamber; and a second handle that extends from a top surface of the second body to a top surface of the cylinder block, an exterior diameter of the second handle being less than an exterior diameter of the second body.

5. The engine cooling system of claim 4, wherein the coolant flowing to the rear side of the block coolant chamber through the exhaust side is capable of passing the rear insert through the first handle and between the bottom surface of the block coolant chamber and the projection.

6. The engine cooling system of claim 4, wherein the block coolant chamber includes a lower chamber formed between the bottom surface of the block coolant chamber and the projection and an upper chamber formed above lower chamber.

7. The engine cooling system of claim 1, further comprising:

an intake side insert and an exhaust side insert disposed at the intake side and the exhaust side, wherein the intake side insert is disposed at the rear of the front insert and the exhaust side insert is disposed in front of the rear insert in the block coolant chamber.

8. The engine cooling system of claim 7, wherein each of the intake side insert and the exhaust side insert includes a rising part having an increased height, a descending part having a reduced height, and a handle formed between the rising part and the descending part.

9. The engine cooling system of claim 1, further comprising:

a cylinder head disposed above the cylinder block and having a head coolant chamber formed therein; and a head gasket interposed between the cylinder head and the cylinder block.

10. The engine cooling system of claim 9, wherein the head gasket includes a first main passage and a second main passage through which the coolant passes from the front side of the block coolant chamber to a front side of the head coolant chamber corresponding to the front side of the block coolant chamber.

11. The engine cooling system of claim 9, wherein the head gasket includes an auxiliary passage through which the coolant passes to the head coolant chamber from the block coolant chamber, and the auxiliary passage includes a first auxiliary passage and a second auxiliary passage formed in front and at the rear of the front insert, respectively.

12. The engine cooling system of claim 9, further comprising:

a coolant control valve unit mounted at a rear side of the cylinder head to receive the coolant from the head coolant chamber, and to adjust the coolant exhausted from the block coolant chamber.

13. The engine cooling system of claim 12, further comprising:

a block coolant temperature sensor configured to detect coolant flowing through the block coolant chamber; and a valve coolant temperature sensor configured to detect coolant flowing through the coolant control valve unit.

14. The engine cooling system of claim 12, wherein the block coolant chamber includes a bridge passage that connects the exhaust side of the block coolant chamber with the intake side of the block coolant chamber between cylinders.

15. The engine cooling system of claim 14, wherein the coolant control valve unit is configured to control the coolant exhausted from an outlet disposed at the rear side of the block coolant chamber.

16. The engine cooling system of claim 14, further comprising:

a coolant pump configured to pump the coolant to an inlet disposed at the front side of the block coolant chamber.

* * * * *